US009973841B2

(12) United States Patent
Chun et al.

(10) Patent No.: US 9,973,841 B2
(45) Date of Patent: May 15, 2018

(54) EARBUD SET, AND HEARING AID AND EARPHONE USING SAME

(71) Applicant: GOELBIO CO., LTD., Bupyeong-gu, Incheon (KR)

(72) Inventors: Chang Chun, Goyang-si (KR); Kyung Min Lee, Seoul (KR)

(73) Assignee: GOELBIO CO., LTD., Incheon (KR)

( * ) Notice: Subject to any disclaimer, the term of this patent is extended or adjusted under 35 U.S.C. 154(b) by 0 days. days.

(21) Appl. No.: 15/104,474

(22) PCT Filed: Dec. 2, 2014

(86) PCT No.: PCT/KR2014/011697
§ 371 (c)(1),
(2) Date: Jun. 14, 2016

(87) PCT Pub. No.: WO2015/093755
PCT Pub. Date: Jun. 25, 2015

(65) Prior Publication Data

US 2017/0006370 A1 Jan. 5, 2017

(30) Foreign Application Priority Data

Dec. 20, 2013 (KR) ..... 10-2013-0159928

(51) Int. Cl.
*H04R 1/10* (2006.01)
*H04R 25/00* (2006.01)
*H04R 25/02* (2006.01)

(52) U.S. Cl.
CPC ..... *H04R 1/105* (2013.01); *H04R 25/02* (2013.01); *H04R 25/652* (2013.01); *H04R 1/10* (2013.01);

(Continued)

(58) Field of Classification Search
CPC ..... H04R 1/10; H04R 1/105; H04R 1/1058; H04R 1/1016; H04R 1/1066; H04R 25/656; H04R 25/02
See application file for complete search history.

(56) References Cited

U.S. PATENT DOCUMENTS

2011/0123059 A1* 5/2011 Hu ..... H04R 1/1016 381/380
2013/0121519 A1* 5/2013 Karlsen ..... H04R 25/02 381/330

FOREIGN PATENT DOCUMENTS

JP 2010-200074 A 9/2010
KR 20-0393227 Y1 8/2005

(Continued)

OTHER PUBLICATIONS

International Search Report (ISR) dated Jan. 29, 2015, for PCT/KR2014/011697, and English translation thereof.

*Primary Examiner* — Matthew Eason
(74) *Attorney, Agent, or Firm* — Bacon & Thomas, PLLC

(57) ABSTRACT

An ear bud set comprises: a body part; a leg part foldably connected to the body part; and an elastic body connected to the body part and a foldable portion of the leg part. The earbud set is stably provided in the ears when being used for the hearing aid or the earphone, the Bluetooth and the like, and thus is not easily separated from the ears despite vigorous motion, and since earholes are ventilated and external sound can be heard after being worn in the ears, sound transmission efficiency capable of preventing a safety accident is effective. The earbud set can be stably worn in the ears irrespective of the different shapes and sizes of ears of people, does not cause earaches by dispersing the force applied to the ears, and can be stably provided to the ears with low pressure.

13 Claims, 6 Drawing Sheets

(52) U.S. Cl.
CPC ..... *H04R 1/1016* (2013.01); *H04R 2420/07* (2013.01); *H04R 2460/13* (2013.01)

(56) References Cited

FOREIGN PATENT DOCUMENTS

| | | | |
|---|---|---|---|
| KR | 10-0695543 | B1 | 3/2007 |
| KR | 20-0466579 | Y1 | 4/2013 |

* cited by examiner

[FIG. 1]
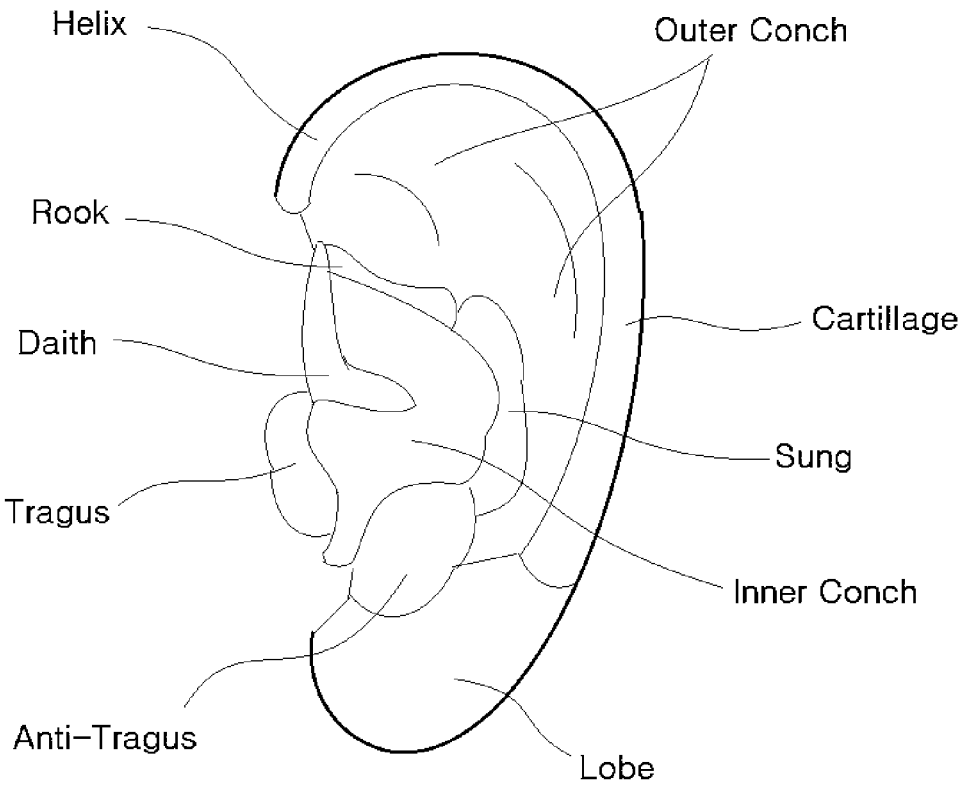

[FIG. 2]
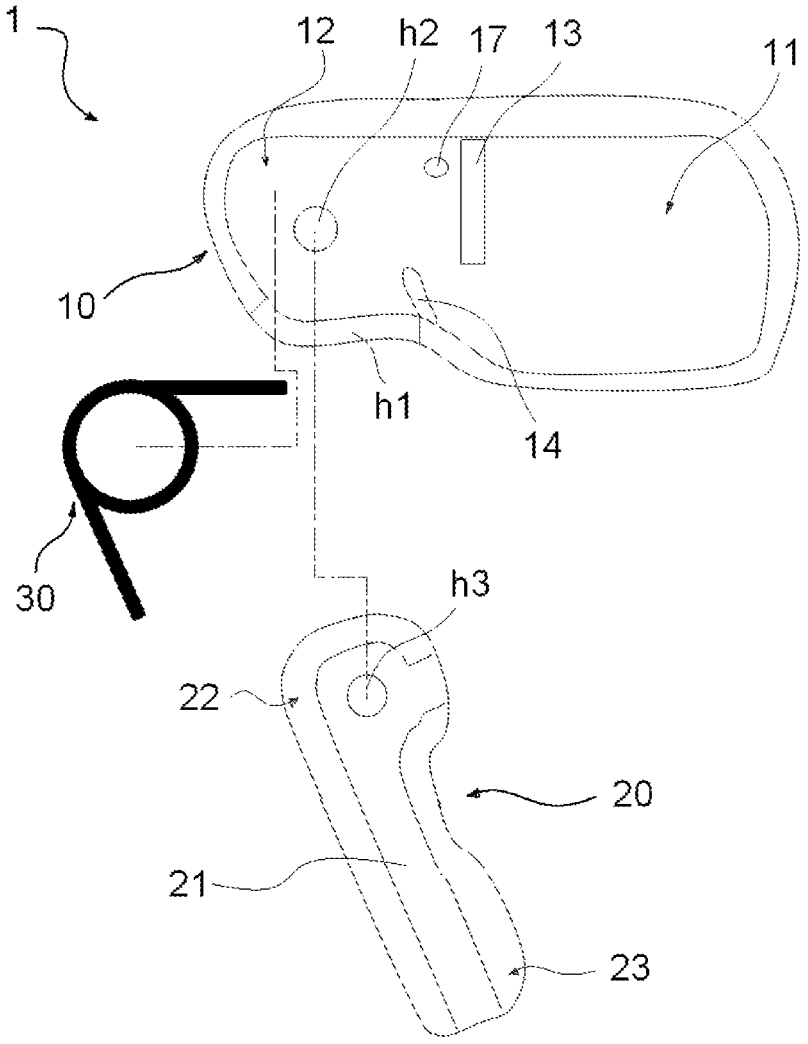

[FIG. 3]
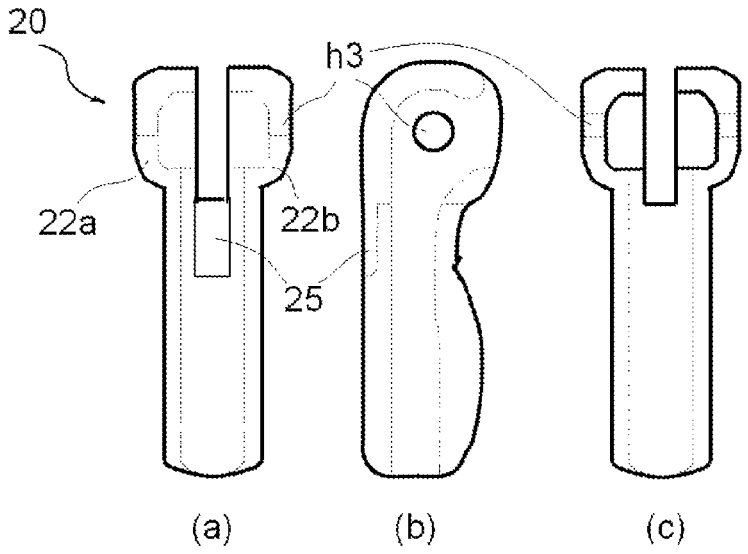
[FIG. 4]
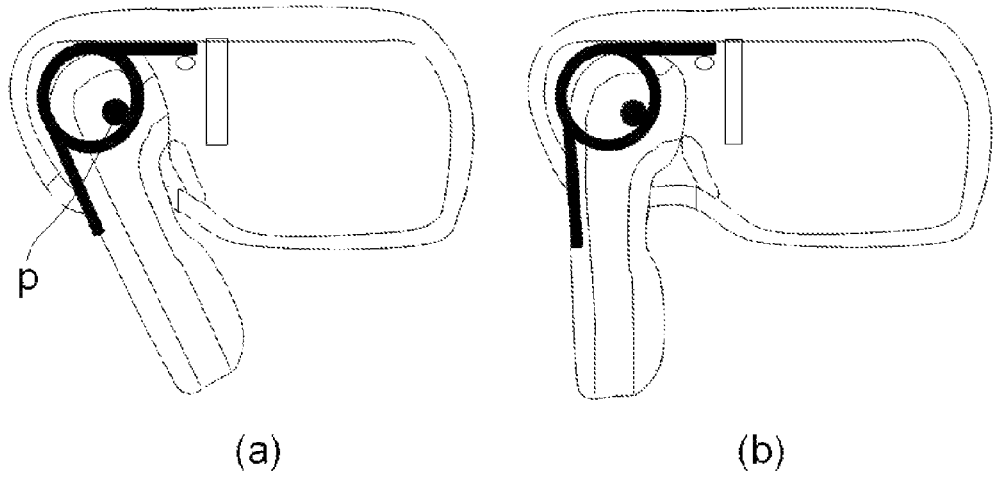

[FIG. 5]
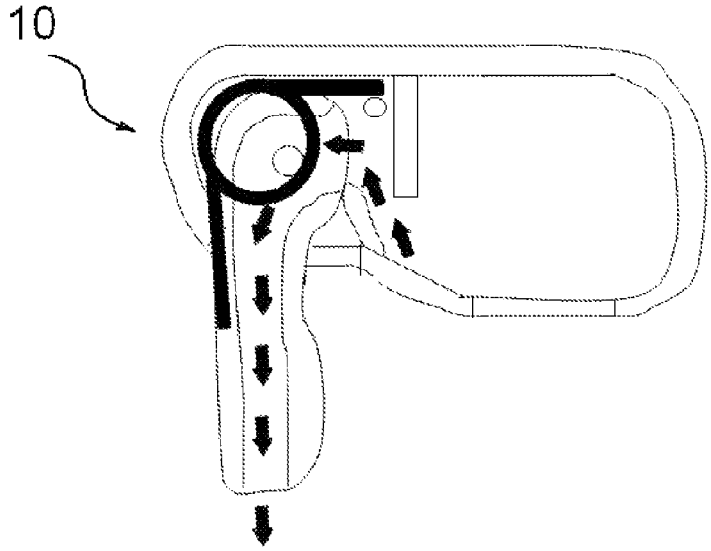
SOUND DELIVERY PATH VIA AIR
[FIG. 6]
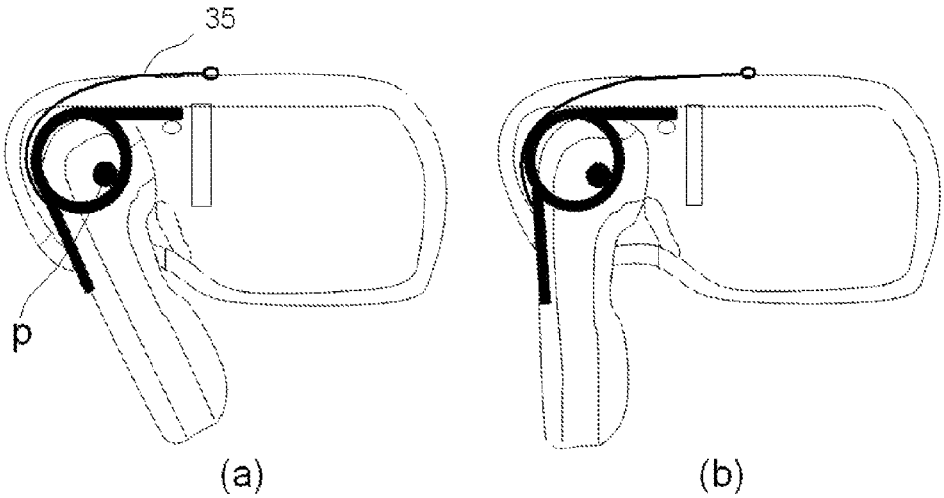

[FIG. 7]
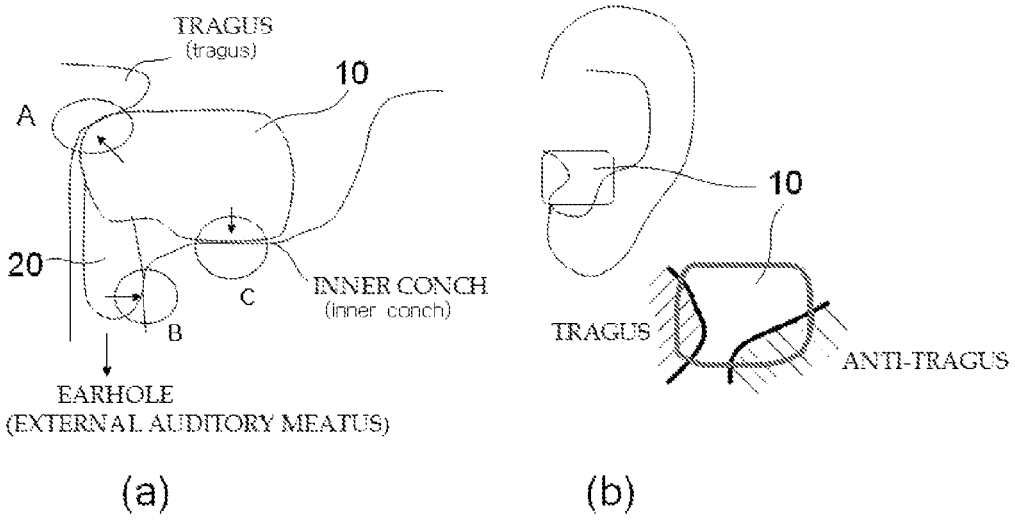
[FIG. 8]
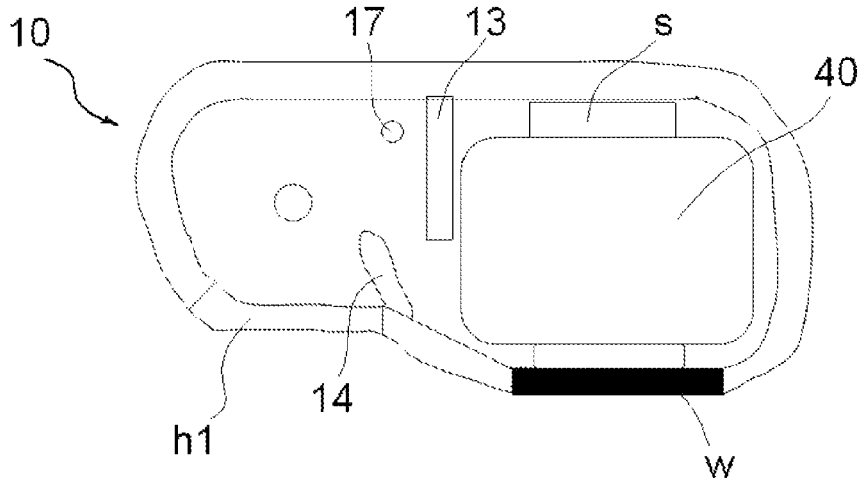

[FIG. 9]
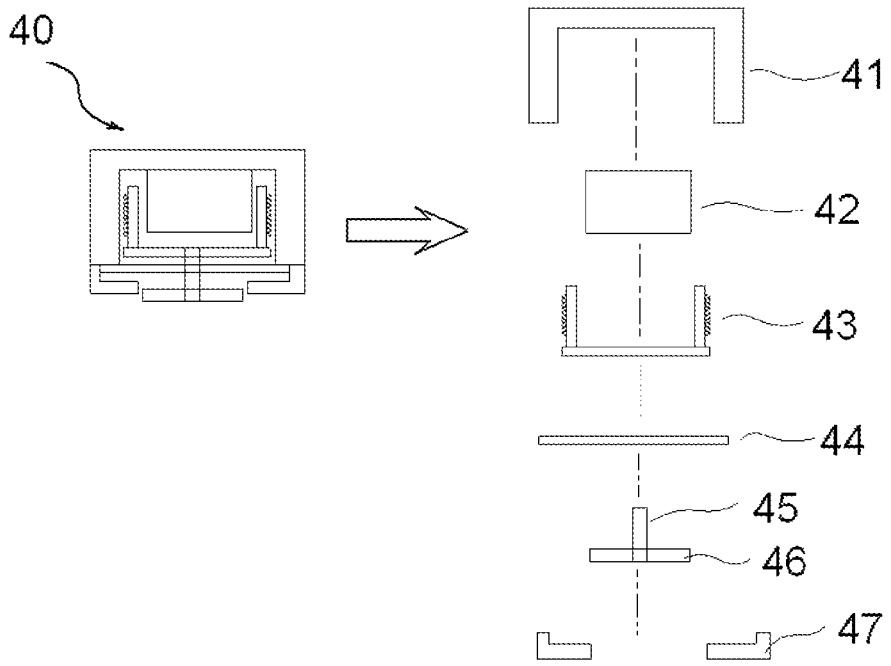
[FIG. 10]
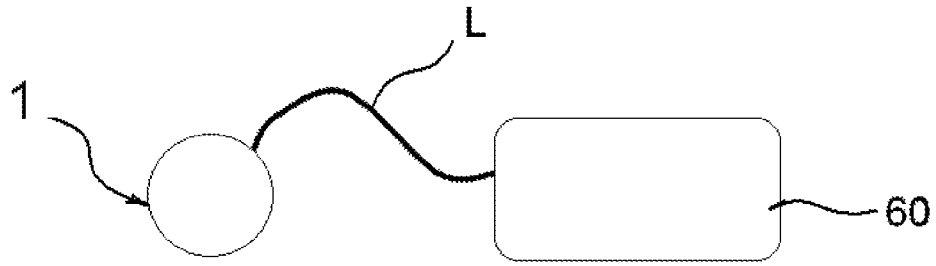

EARBUD SET, AND HEARING AID AND EARPHONE USING SAME

BACKGROUND OF THE INVENTION

The present invention relates to an earbud set, and more particularly, to an earbud set which is used for a hearing aid, an earphone, or Bluetooth, and is stably worn on the ear regardless of a shape or size of the ear of a user and can efficiently deliver sound and vibration; a hearing aid, an earphone, and Bluetooth using the same.

BACKGROUND OF THE INVENTION

In general, sound is transferred to auditory nerves of a human body through three ways such as air conduction, bone conduction, and skin conduction, and a human body detects sound using the above.

Among the above, sound conduction by air conduction is a way to transfer sound through general air. That is, vibration of air which is made by a speaker vibrates eardrum and a human body (or a user) senses sound. Sound conduction by bone conduction indicates that a bone conduction transducer converts a sound signal to vibration, and sound is delivered through the bone of a human body (or a user) so that a user can detect sound. In this case, it is necessary that a bone conduction transducer is attached to a part which is closer to the ear with appropriately level of pressure, or a structure to which a bone conduction transducer is attached is installed in the skull through surgical operation. Sound conduction by skin conduction is a way to deliver sound through vibration of external skin of earhole. That is, by delivering a signal of the bone conduction transducer to skin of earhole, a human body (or a user) senses sound. For efficient sound transfer, an ear phone, a head phone, a hearing aid, and a Bluetooth which transfers information or sound wireless within short distance are used.

As to a general earphone, a solid material which is bigger than the earhole is inserted and fixed to tragus and anti-tragus or inside the earhole, and there is an open type and a canal type (see the shape of the ear of FIG. 1)

An open type indicates that a circular-shape earphone is inserted into tragus and anti-tragus. The tragus and anti-tragus are cartilage tissue which plays a role of a support base of an earphone, and they do not endure external small force, and therefore, there is a problem in that the earphone is well come off. In addition, a canal-type earphone has a shape of a straight line or "¬" shape. In order to fix the earphone on the earhole, a part which enters the earhole is covered with a silicon cap to fix an earphone attached through elasticity of the silicon cap and tragus (and anti-tragus). In the similar manner as the foregoing, an earphone can come off easily, or a user may feel inconvenience due to the silicon cap which fills earholes tightly. As earholes are tightly covered and is not ventilated well, and thus, there are problems that, when a user wears an earphone for a longer time or in the summer, inside the earphone can be damp, and due to excessive pressure, a user may feel pain on his/her hears and eardrum may have a problem.

In addition, in order to deliver sound through the bone, i.e., a signal of the bone conduction transducer is transmitted to the bone and be delivered the auditory nerves, a headphone type, a canal type, or the like has been developed. Among the above, a headphone type is inconvenient when a headphone is worn, and as a bone conduction transducer is away from the earhole which is a position having the best sound delivery efficiency and is in contact with temple located at a front part of earhole, efficiency decreases. In case of a canal type, it gives pressure on the earhole, and a silicon cap part fills the earhole too tightly, and a user may be uncomfortable. Since a silicon cap enters the earhole and is fixed there, and an entire of the earbud set vibrates, and a silicon vibrates by the vibration of the earbud set and delivers vibration, there is a large loss of kinetic energy, and accuracy in a signal falls, thus failing to deliver clear sound quality.

In this regard, provided is an earbud set, a hearing aid, and an earphone using the earbud set which is stably provided in the ears, and even after being worn, the earbud set enables earholes to be ventilated, and a user can hear external sound, and thus, safety accident can be prevented. In addition, in spite of vigorous motion, the present invention is not easily separated, and the present invention has good sound transmission efficiency.

SUMMARY OF THE INVENTION

Therefore, the present invention has been made to solve the above-mentioned problems occurring in the prior arts, an earbud set and a hearing aid and an ear phone using the same are provided. It is a first object of the present invention to provide an earbud set of which a body part and a leg part are foldably connected by an elastic body, and thus is not easily detached from the ear and is stably worn on the ear. In addition, after the earbud set being worn on the ear, earhole is ventilated well, and outside sound can be heard, thus preventing safety accident and having a good sound delivery effect.

In order to solve the above-mentioned problems, an earbud according to an embodiment includes:

a body part;

a leg part foldably connected to the body part; and an elastic body connected to the body part and a foldable portion of the leg part.

In addition, in the earbud set according to the exemplary embodiment, the body part which is a hollow polyhedron of which corners are rounded is characterized in that the body is divided into an internal portion and a foldable part, an upper surface or a lower surface of the internal portion has a hole so as to penetrate through an outside or an inside of the internal portion, a lower surface of the foldable part is coupled with a head of the leg part, a through hole in a predetermined size is formed so that the leg part can move forward and backward, and a hole is formed at both sides of the foldable part so that a coupling pin is coupled, and that a partition wall which is fixed to an upper surface and is spaced apart from a lower surface is provided between the internal portion and the foldable part, and a guiding part which projects obliquely toward the foldable part from a lower surface is provided at a position which is spaced apart from the partition wall toward the foldable part.

In the earbud set, an induction pipe is formed by the partition wall and the guiding part.

In the earbud set, a penetration path in a shape of '¬' is provided inside the leg, and the leg comprises a head which is coupled to the foldable part of the body part and a foot which is inserted into earhole, wherein the head is divided into two parts with a middle portion being incised, a long groove is formed from the incised portion towards the foot, and a hole is formed on the head so that a coupling pin is fitted.

In the earbud set, the through path is connected to the guiding pipe.

In the earbud set, the elastic body is spring or a material with elastic restoring force, one side of the elastic body is fixed to an upper side inside the foldable part of the body part, and another side is fixed to a leg part, and elastic restoring force is applied with respect to relative movement of the body part and the leg.

In the earbud set, the leg further comprises a pulling string, enabling to facilitate association of the leg from the body part, when the earbud set is attached to or detached from the ears.

In the earbud set, when the earbud set is worn in the ears, restoring force of the elastic body is dispersed to at least three parts, and the earbud set is supported inside the ears.

In the earbud set, a bone conduction transducer, speaker, receiver/transmitter, or Bluetooth are mounted inside the earbud set.

In the earbud set, the bone conduction transducer comprises a cylindrical yoke; a magnet fixed to an upper part of inside the yoke; bobbin wrapping the magnet and ring-type coil; a supporting unit which supports the bobbin and coil and is connected to a vibration plate; a diaphragm ring which is inserted to an open end of the yoke and closes a bottom surface of the yoke; and a cover which covers the open end of the yoke and includes a cylindrical hole so that the vibrating plate moves upward and downward.

In the earbud set, the bone conduction transducer simultaneously generates a signal (sound wave) by vibration of air and a signal through the bone (bone conduction), the bone conduction vibration wave is directly delivered to the bone via inner conch, the sound wave generated from the bone conduction transducer is delivered to earhole through the guiding pipe and the pipe path of the earbud set, and a part of vibration wave generated from the bone conduction transducer is delivered through internal skin of the earhole against which the foot of the leg part is pressed, by vibrating the leg part of the earbud set.

In addition, a hearing aid, an earphone, or a Bluetooth include the earbud set according to the present embodiment.

When the earbud set according to the embodiment is used for a hearing aid, an earphone, or Bluetooth, the earbud set is mounted on the ear stably and is not easily come off despite intense movement. After wearing the earbud set, earhole is well ventilated and outside sound can be heard, and thus, safety-accident can be prevented. Thus, the present invention has an excellent effect of sound delivery.

In addition, the earbud set according to the embodiment can be stably worn in the ear regardless of different shapes and size of the ears of persons. Further, power applied to the ear is dispersed, not causing pain to the ear. Even with a small pressure, the earbud set can be stably worn.

BRIEF DESCRIPTION OF THE DRAWINGS

The above and/or other aspects of the present inventive concept will be more apparent by describing certain exemplary embodiments of the present inventive concept with reference to the accompanying drawings in which:

FIG. 1 illustrates an ordinary shape of the ear,

FIG. 2 illustrates briefly an exploded sectional view of the earbud set in accordance with an exemplary embodiment, FIGS. 3(*a*)-(*c*) illustrates briefly side sectional views of a shape of leg of FIG. 2, FIG. 4 is a drawing illustrating before and after wearing a fabricated earbud set of FIG. 2, FIG. 5 is a drawing illustrating a path of transferring sound via air after the earbud set is mounted on the ear, FIGS. 6 (*a*) and (*b*) are drawings illustrating a state of an earbud set by the pulling string, FIGS. 7(*a*) and (*b*) are drawings briefly illustrating the earbud set and a state that the earbud set is worn in the ear, FIG. 8 is a drawing illustrating a state that a bone conduction transducer is mounted on inside of the earbud set, FIG. 9 illustrates briefly an exploded sectional view of an exemplary embodiment of the bone conduction transducer of FIG. 8, and FIG. 10 is a drawing illustrating that the earbud set is connected to a control box.

DETAILED DESCRIPTION OF THE INVENTION

The preferred embodiments of the invention will be hereinafter described in more detail with reference to the accompanying drawings.

Embodiments of the present invention will be described in more detail hereinafter with reference to the accompanying drawings. The present invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the shapes and sizes of respective elements may be exaggerated for clarity.

FIG. 2 illustrates briefly an exploded sectional view of the earbud set in accordance with an exemplary embodiment. FIGS. 3(*a*)-(*c*) illustrates briefly side sectional views of a shape of leg of FIG. 2. FIG. 4 is a drawing illustrating before and after wearing a fabricated earbud set of FIG. 2. FIG. 5 is a drawing illustrating a path of transferring sound via air after the earbud set is mounted on the ear. FIGS. 6 (*a*) and (*b*) are drawings illustrating a state of an earbud set by the pulling string. FIGS. 7(*a*) and (*b*) are drawings briefly illustrating the earbud set and a state that the earbud set is worn in the ear. FIG. 8 is a drawing illustrating a state that a bone conduction transducer is mounted on inside of the earbud set. FIG. 9 illustrates briefly an exploded sectional view of an exemplary embodiment of the bone conduction transducer of FIG. 8. FIG. 10 is a drawing illustrating that the earbud set is connected to a control box.

As illustrated in FIG. 2, an earbud set 1 according to an exemplary embodiment includes a body part 10, a leg part 20 foldably connected, and an elastic body 30 connected to the body part and a foldable portion of the leg part. A shape of the earbud set according to an exemplary embodiment is merely exemplary and is not limited thereto, and an external design or a shape thereof may change to suit for a use.

The body part 10 is a hollow polyhedron of which corners are rounded. Inside the body part, there are an internal portion which may provide a bone conduction transducer, speaker, or Bluetooth, and a foldable part 12 connected to a leg part 20. An upper surface or a lower surface of the internal portion 11 has a hole so as to penetrate through an outside or an inside of the internal portion, a lower surface of the foldable part is coupled with a head of the leg part, a through hole h1 in a predetermined size is formed so that the leg part can move forward and backward, and a hole h2 is formed at both sides of the foldable part so that a coupling pin (p) is coupled. A partition wall 13 which is fixed to an upper surface and is spaced apart from a lower surface is provided between the internal portion and the foldable part, and a guiding part 14 which projects obliquely toward the foldable part from a lower surface is provided at a position which is spaced apart from the partition wall toward the foldable part. In addition, a spring support 17 can be further formed at an upper side of the foldable part toward the partition wall to be spaced apart from the upper part.

Through the guiding pipe which is formed by the partition wall and the guiding part, sound or vibration wave can be transferred via air, from the internal portion to the foldable part, as illustrated in FIG. 5.

The leg 20 is a polyhedron having a straight line shape which is foldably connected to the body part. As illustrated in FIGS. 2 and 3, a penetration path 21 in a shape of '¬' is provided inside the leg, and the leg 20 includes a head 22 which is coupled to the foldable part of the body part 10 and a foot 23 which is inserted into earhole. The head 22 is divided into two parts 22A and 22B with a middle portion being incised, and a long groove 25 is formed from the incised portion towards the foot 23 so that the elastic body such as spring can be fixed to the leg. In addition, a hole h3 which corresponds to the hole h2 of the foldable part is formed on the head 22*a*, 22*b* so that a coupling pin (p) can be coupled. Here, the penetration path 21 is connected to the guiding pipe, and sound or vibration wave transferred through the guiding pipe is transferred to earhole through the penetration path (see FIG. 5).

The elastic body 30 is a spring or an elastic material. The elastic body is connected to the body part and the foldable part of the leg. As illustrated in FIGS. 4 and 5, one side of the body is supported and fixed by the spring supporter 17 provided on an upper side inside the foldable part of the body part and another side is supported and fixed to a groove 25 of the leg part. The elastic restoring force is added with respect to relative movement of the body part and the leg part. Here, when the elastic body is a spring, it is preferable that the coupling pin is located at an inner edge of the central circle of the spring.

In addition, as illustrated in FIG. 6, so that movement of the leg part would be easy when attaching or detaching the earbud set to the ears, the pulling string 35 connected to the leg can be further provided on an upper surface of outside of the body. Through the pulling string, pulling the leg connected to the elastic body would be easier.

The earbud set which is configured as described above is positioned as illustrated in FIG. 7.

In other words, when the leg part of the earbud set 1 is spread from the body part and is inserted into earhole, the leg part and the body part have a force that each is folded toward each other by the restoring force of the spring which is the elastic body 30. In this case, the restoring force of spring is divided into three parts, and helps that the earbud set is stably supported inside the ear. In addition, the foot of the leg part is pressed at part B which is inside the earhole, and a lower side of the inner part of the body part is pressed at part C of the inner conch, and the foldable part which is pushed backward is stably mounted inside the ear, stably being pressed at part A of tragus, without departing from the ear. Furthermore, due to structure of the ear, anti-tragus covers a portion of the body part, and thus, even when a user moves his/her body or does exercise, the present invention is not easily detached. According to the structure of the earbud set, there is no limitation in thickness or size of the body part and the leg part, and thus, earhole can be well ventilated, and it is not necessary to wear a silicon ear cap to make the earbud set to be well attached to the earhole. In addition, in spite of differences in shape, size, and earhole of persons, a user may not feel uncomfortable, feeling comfortable only.

FIG. 8 is a drawing illustrating a state that the bone conduction transducer which is used for a hearing aid is mounted inside the internal portion of the earbud set, according to an embodiment. As described, in the internal portion 11 of the body part, the bone conduction transducer 40 is fixed at an upper part with the fixed cushion (S), and it seems preferable that a lower surface of the internal portion 11 which is adjacent to the vibration plate 46 of the bone conduction transducer is composed of silicon rubber or soft plastic material (W), a through hole which penetrates a lower surface of the internal portion is formed, and the vibration plate where the silicon rubber is attached is protruding directly toward outside.

FIG. 9 is an exploded sectional view illustrating an exemplary embodiment of the bone conduction transducer, illustrating a cylindrical yoke 41, a magnet 42 fixed to an upper part of inside the yoke, bobbin wrapping the magnet and ring-type coil 43, a supporting unit 45 which supports the bobbin and coil and is connected to a vibration plate 46, diaphragm ring which is inserted to an open end of the yoke and closes a bottom surface of the yoke, and a cover 47 which covers the open end of the yoke and includes a cylindrical hole so that the vibrating plate moves upward and downward.

The bone conduction transducer simultaneously generates a signal (sound wave) by vibration of air and signal (bone conduction) through bone, and the bone conduction vibration wave generated by the bone conduction transducer is directly transferred to bone through the inner conch. In addition, the sound wave generated from the bone conduction transducer is delivered to earhole through the guiding pipe and the penetration path of the earbud set. Furthermore, a portion of the vibration wave generated from the bone conduction transducer vibrates the leg of the earbud set, and is transferred through internal skin of earhole to which foot part is in contact.

The present disclosure exemplifies a bone conduction transducer as an example of a unit which is mounted at the internal portion of the body part, but this is merely exemplary and is not limited thereto. A speaker or a bone conduction speaker can be mounted, or a receiver/transmitter or Bluetooth can be provided as well.

FIG. 10 illustrates that the earbud set is connected to a control box according to an exemplary embodiment. The control box can be made to be small so that it can be held at a back of the ears or as a necklace type.

In case of the earbud set according to an exemplary embodiment, a bone conduction transducer provided at the internal portion or a speaker can be connected to a control box 60 where a battery, a circuit board, or a microphone through the withdrawal line (L). In case of the Bluetooth, short distance wireless transmission/receipt function is available, and thus a separate withdrawal line is not necessary. A control box receives sound from outside through a microphone and drives a bone conduction transducer inside the earbud set through controlling. At this time, power generated by Fleming's Left-hand Law in accordance with disposition of coil and magnet vibrates a vibration plate upward and downward.

As such, by a vibrating plate of the bone conduction transducer which vibrates upward and downward, a signal (sound wave) by vibration of air and a signal (bone conduction) through bone are simultaneously generated. The bone conduction vibration wave generated from the bone conduction transducer is directly transferred, through inner conch, to skull which forms cranial and the internal ear, and sound wave generated from the bone conduction transducer is transferred to ear drum inside the earhole through the guiding pipe and penetration path of the earbud set. In addition, a part of vibration wave generated from the bone conduction transducer vibrates the leg of the earbud set and is transferred through the internal skin to which foot of the leg is pressed. As such, through three ways, that is, by transferring a signal through the earhole, bone, and skin, auditory nerves are stimulated, and a user can hear good quality sound.

More particularly, when the earbud set is applied to a hearing aid, a vibrating part of the bone conduction transducer is attached to the inner conch with an appropriate pressure, and thus, the bone conduction signal can be efficiently transferred.

The description of the present invention described above, are intended for purposes of illustration, those skilled in the art to which this invention belongs, other specific without changing the technical spirit or essential features of the present invention it will be able to understand that easily deformed in such form is possible. Accordingly, the embodiments described above shall be understood not illustrative in and restrictive in all respects. For example, each component is described by a single type may be carried out are distributed, components that are described as being dispersed in the same manner can also be carried out in bonded form.

The foregoing embodiments and advantages are merely exemplary and are not to be construed as limiting the present invention. The present teaching can be readily applied to other types of apparatuses. Also, the description of the exemplary embodiments of the present inventive concept is intended to be illustrative, and not to limit the range of the claims, and many alternatives, modifications, and variations will be apparent to those skilled in the art.

The present invention is purposed to be used for a hearing aid, an earphone, or Bluetooth. Regardless of a shape or size of the ear of a user, the earbud set can be stably mounted to the ear, and desired sound and vibration can be efficiently transferred. With this structure, the earbud set can be applied to a hearing aid, an earphone, and Bluetooth.

While the present invention have been described in connection with the exemplary embodiments illustrated in the drawings, it will be appreciated that they are merely an illustrative embodiments and various equivalent modifications and variations of the embodiments can be made by a person having an ordinary skill in the art without departing from the spirit and scope of the present invention. Therefore, the appended claims also include such modifications and variations falling within the true technical scope of the present invention.

What is claimed is:

1. An earbud set comprising:

a body part;

a leg part foldably connected to the body part; and an elastic body connected to the body part and a foldable portion of the leg part, wherein, when an earbud set is worn in the ears, restoring force of the elastic body is dispersed to at least three parts, and the earbud set is supported inside the ears, and wherein the body part which is a hollow polyhedron of which corners are rounded is characterized in that the body is divided into an internal portion and a foldable part, an upper surface or a lower surface of the internal portion has a hole so as to penetrate through an outside or an inside of the internal portion, a lower surface of the foldable part is coupled with a head of the leg part, a through hole in a predetermined size is formed so that the leg part can move forward and backward, and a hole is formed at both sides of the foldable part so that a coupling pin is coupled, and that a partition wall which is fixed to an upper surface and is spaced apart from a lower surface is provided between the internal portion and the foldable part, and a guiding part which projects obliquely toward the foldable part from a lower surface is provided at a position which is spaced apart from the partition wall toward the foldable part.

2. The earbud set as claimed in claim 1, wherein an induction pipe is formed by the partition wall and the guiding part.

3. The earbud set as claimed in claim 1, wherein a penetration in a shape of a right angle is provided inside the leg, and the leg comprises a head which is coupled to the foldable part of the body part and a foot which is inserted into earhole, wherein the head is divided into two parts with a middle portion being incised, a long groove is formed from the incised portion towards the foot, and a hole is formed on the head so that a coupling pin is fitted.

4. The earbud set as claimed in claim 3, wherein the through path is connected to the guiding pipe.

5. The earbud set as claimed in claim 1, wherein the elastic body is spring or a material with elastic restoring force, one side of the elastic body is fixed to an upper side inside the foldable part of the body part, and another side is fixed to a leg part, and elastic restoring force is applied with respect to relative movement of the body part and the leg.

6. The earbud set as claimed in claim 1, wherein the leg further comprises a pulling string, enabling to facilitate association of the leg from the body part, when the earbud set is attached to or detached from the ears.

7. The earbud set as claimed in claim 1, wherein a bone conduction transducer, speaker, receiver/transmitter, or Bluetooth are mounted inside the earbud set.

8. An earbud set comprising:

a body part;

a leg part foldably connected to the body part; and an elastic body connected to the body part and a foldable portion of the leg part, wherein, when an earbud set is worn in the ears, restoring force of the elastic body is dispersed to at least three parts, and the earbud set is supported inside the ears, wherein a bone conduction transducer, speaker, receiver/transmitter, or Bluetooth are mounted inside the earbud set, and wherein the bone conduction transducer comprises a cylindrical yoke; a magnet fixed to an upper part of inside the yoke; bobbin wrapping the magnet and ring-type coil; a supporting unit which supports the bobbin and coil and is connected to a vibration plate; a diaphragm ring which is inserted to an open end of the yoke and closes a bottom surface of the yoke; and a cover which covers the open end of the yoke and includes a cylindrical hole so that the vibrating plate moves upward and downward.

9. The earbud set as claimed in claim 7, wherein the bone conduction transducer simultaneously generates a signal (sound wave) by vibration of air and a signal through the bone (bone conduction), the bone conduction vibration wave is directly delivered to the bone via inner conch, the sound wave generated from the bone conduction transducer is delivered to earhole through the guiding pipe and the pipe path of the earbud set, and a part of vibration wave generated from the bone conduction transducer is delivered through internal skin of the earhole against which the foot of the leg part is pressed, by vibrating the leg part of the earbud set.

10. A hearing aid including the earbud set of claim 7.

11. An ear phone including the earbud set of claim 7.

12. A Bluetooth device including the earbud set of claim 7.

13. An earbud set comprising:

a body part;

a leg part foldably connected to the body part; and an elastic body connected to the body part and a foldable portion of the leg part, wherein the earbud set is configured to have a restoring force of the elastic body that may be dispersed to at least three parts, and the earbud set is configured to be supported inside an ear, wherein the elastic body is a spring or a material with elastic restoring force, one side of the elastic body is fixed to an upper side inside the foldable part of the body part, and another side is fixed to the leg part, and the elastic restoring force is applied with respect to relative movement of the body part and the leg.

* * * * *